US010522102B2

(12) United States Patent
Hao

(10) Patent No.: US 10,522,102 B2
(45) Date of Patent: Dec. 31, 2019

(54) DISPLAY PANEL AND LIQUID CRYSTAL DISPLAY WITH ENHANCED VIEWING-ANGLE COLOR DEVIATION AND IMPROVED DISPLAY QUALITY

(71) Applicant: SHENZHEN CHINA STAR OPTOELECTRONICS SEMICONDUCTOR DISPLAY TECHNOLOGY CO., LTD., Shenzhen, Guangdong (CN)

(72) Inventor: Sikun Hao, Guangdong (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 16/040,612

(22) Filed: Jul. 20, 2018

(65) Prior Publication Data

US 2019/0251917 A1 Aug. 15, 2019

Related U.S. Application Data

(63) Continuation of application No. PCT/CN2018/080262, filed on Mar. 23, 2018.

(30) Foreign Application Priority Data

Feb. 9, 2018 (CN) ..... 2018 1 0140534

(51) Int. Cl.
*G09G 3/36* (2006.01)

(52) U.S. Cl.
CPC ..... *G09G 3/3607* (2013.01); *G09G 3/3648* (2013.01); *G09G 2300/0447* (2013.01); (Continued)

(58) Field of Classification Search
CPC ..... G09G 3/3644; G09G 3/3666; G09G 2300/0439–0895
See application file for complete search history.

(56) References Cited

U.S. PATENT DOCUMENTS

2004/0105051 A1 6/2004 Chuang
2007/0153146 A1 7/2007 Shih
(Continued)

FOREIGN PATENT DOCUMENTS

CN 101140943 A 3/2008
CN 101546073 A 9/2009
CN 106292106 A 1/2017

OTHER PUBLICATIONS

International search report dated Dec. 5, 2018 from corresponding application No. PCT/CN2018/080262.

*Primary Examiner* — Sanghyuk Park
(74) *Attorney, Agent, or Firm* — Leong C. Lei

(57) ABSTRACT

A display panel and a liquid crystal display (LCD) are disclosed. The display panel includes multiple basic pixel units arranged in an array. Each basic pixel unit includes a first pixel unit and a second pixel unit aligned vertically. When the first and second pixel units are under a same effective input signal, the selected sub-pixel unit of the first pixel unit has a greater voltage on its liquid crystal capacitor than that of the selected sub-pixel unit of the second pixel unit. The present invention provides different voltages on the sub-pixel units' liquid crystal capacitors, thereby improving LCD's viewing angle, color deviation, and display quality.

8 Claims, 4 Drawing Sheets

(52) U.S. Cl.
CPC ..... *G09G 2320/028* (2013.01); *G09G 2320/0242* (2013.01)

(56) References Cited

U.S. PATENT DOCUMENTS

| | | | | |
|---|---|---|---|---|
| 2011/0298772 | A1* | 12/2011 | Saitoh | G09G 3/3648 345/211 |
| 2016/0035292 | A1* | 2/2016 | Lee | G09G 3/3648 345/694 |
| 2016/0217754 | A1* | 7/2016 | Bae | G09G 3/3614 |

* cited by examiner

DISPLAY PANEL AND LIQUID CRYSTAL DISPLAY WITH ENHANCED VIEWING-ANGLE COLOR DEVIATION AND IMPROVED DISPLAY QUALITY

CROSS-REFERENCE TO RELATED APPLICATIONS

This application is a continuing application of PCT Patent Application No. PCT/CN2018/080262, filed on Mar. 23, 2018, which claims priority to Chinese Patent Application No. 201810140534.2, filed on Feb. 9, 2018, both of which are hereby incorporated herein by reference in their entireties.

BACKGROUND OF THE INVENTION (a) Technical Field of the Invention

The present invention is generally related to display technologies, and more particular to a display panel and a liquid crystal display.

(b) Description of the Prior Art

Liquid crystal display (LCD) is the mainstream flat-panel display, commonly applied in electronic products requiring high-resolution color display such as mobile phone, Personal Digital Assistant (PDA), digital camera, monitor, and notebook computer. Current LCDs have two types of driving mechanisms: single gate drive, and tri-gate drive. Both mechanisms have shortcomings that the LCDs suffer color deviation when viewed at a large viewing angle, d contrast is also compromised. These problems get even worse as the viewing angle is increased, resulting in inferior viewing angle performance and low display quality.

SUMMARY OF THE INVENTION

Therefore, the present invention provides a display panel and a liquid crystal display (LCD) with enhanced viewing-angle color deviation and improved display quality.

Firstly, the display panel includes multiple basic pixel units arranged in an array. Each basic pixel unit includes a first pixel unit and a second pixel unit.

The first and second pixel units are aligned vertically.

Under a same a same effective input signal, a selected sub-pixel unit of the first pixel unit has a first voltage on its liquid crystal capacitor, a selected sub-pixel unit of the second pixel unit has a second voltage on its liquid crystal capacitor, and the first voltage is greater than the second voltage.

In one embodiment, the first pixel unit includes a first red sub-pixel unit, a first green sub-pixel unit, and a first blue sub-pixel unit, arranged vertically in this order. The second pixel unit includes a second red sub-pixel unit, a second green sub-pixel unit, and a second blue sub-pixel unit, arranged vertically in this order.

In one embodiment, each sub-pixel unit of the first pixel unit includes a first thin-film transistors (TFT) and a first liquid crystal capacitor. The first TFT has its gate electrically connected to a gate line connected to the sub-pixel unit, its source electrically connected to a source line connected to the sub-pixel unit, and its drain electrically connected to a first terminal of the first liquid crystal capacitor. A second terminal of the first liquid crystal capacitor is electrically connected to a first reference voltage. Each sub-pixel unit of the second pixel unit includes a second TFT, a third TFT, and a second liquid crystal capacitor. The second TFT has its gate electrically connected to a gate line connected to the sub-pixel unit, its source electrically connected to a source line connected to the sub-pixel unit, and its drain electrically connected to a first terminal of the second liquid crystal capacitor and the third TFT's source. The third TFT has its gate electrically connected to the gate line connected to the sub-pixel unit, and its drain electrically connected to a second reference voltage. A second terminal of the second liquid crystal capacitor is electrically connected to the first reference voltage.

In one embodiment, the first reference voltage is drawn from a color filter's common line. The second reference voltage is drawn from an array substrate's common line.

In one embodiment, a falling edge of a first pulse signal on a first gate line for a n-th row of sub-pixel units coincides with a rising edge of a second pulse signal on a second gate line for the (n+1)-th row of sub-pixel units. The first and second pulse signals on the first and second gate lines have an identical period. n is a positive integer.

Secondly, the liquid crystal display includes a display panel and a display body. The display panel includes multiple basic pixel units arranged in an array. Each basic pixel unit includes a first pixel unit and a second pixel unit.

The first and second pixel units are aligned vertically.

Under a same a same effective input signal, a selected sub-pixel unit of the first pixel unit has a first voltage on its liquid crystal capacitor, a selected sub-pixel unit of the second pixel unit has a second voltage on its liquid crystal capacitor, and the first voltage is greater than the second voltage.

In one embodiment, the first pixel unit includes a first red sub-pixel unit, a first green sub-pixel unit, and a first blue sub-pixel unit, arranged vertically in this order. The second pixel unit includes a second red sub-pixel unit, a second green sub-pixel unit, and a second blue sub-pixel unit, arranged vertically in this order.

In one embodiment, each sub-pixel unit of the first pixel unit includes a first thin-film transistors (TFT) and a first liquid crystal capacitor. The first TFT has its gate electrically connected to a gate line connected to the sub-pixel unit, its source electrically connected to a source line connected to the sub-pixel unit, and its drain electrically connected to a first terminal of the first liquid crystal capacitor. A second terminal of the first liquid crystal capacitor is electrically connected to a first reference voltage. Each sub-pixel unit of the second pixel unit includes a second TFT, a third TFT, and a second liquid crystal capacitor. The second TFT has its gate electrically connected to a gate line connected to the sub-pixel unit, its source electrically connected to a source line connected to the sub-pixel unit, and its drain electrically connected to a first terminal of the second liquid crystal capacitor and the third TFT's source. The third TFT has its gate electrically connected to the gate line connected to the sub-pixel unit, and its drain electrically connected to a second reference voltage. A second terminal of the second liquid crystal capacitor is electrically connected to the first reference voltage.

In one embodiment, the first reference voltage is drawn from a color filter's common line. The second reference voltage is drawn from an array substrate's common line.

In one embodiment, a filling edge of a first pulse signal on a first gate line for a nth row of sub-pixel units coincides with a rising edge of a second pulse signal on a second gate line for the (n+1)-th row of sub-pixel units. The first and second pulse signals on the first and second gate lines have an identical period. n is a positive integer.

According to the present invention, the display panel includes multiple basic pixel units arranged in an array. Each basic pixel unit includes a first pixel unit and a second pixel unit aligned vertically. When the first and second pixel units are under a same effective input signal, the selected sub-pixel unit of the first pixel unit has a greater voltage on its liquid crystal capacitor than that of the selected sub-pixel unit of the second pixel unit. According to the present invention, by grouping the first and second pixel units together, and providing different voltages on the sub-pixel units' liquid crystal capacitors, LCD's viewing angle, color deviation, and display quality are significantly improved.

The foregoing objectives and summary provide only a brief introduction to the present invention. To fully appreciate these and other objects of the present invention as well as the invention itself all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

To make the technical solution of the embodiments according to the present invention, a brief description of the drawings that are necessary for the illustration of the embodiments will be given as follows. Apparently the drawings described below show only example embodiments of the present invention and for those having ordinary skills in the art, other drawings may be easily obtained from these drawings without paying any creative effort.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

In the following embodiments, the display panel is mainly applied to a liquid crystal display (LCD). The operation principle of liquid crystal is as follows. Liquid crystal is an organic compound. Under room temperature, it reveals the fluidity of liquid and optical properties of crystal. It is therefore called "liquid crystal." Under external influence such as electrical field, magnetic field, temperature, stress, liquid crystal molecules may be re-arranged, thereby altering its optical properties. Based on this photo-electric physical foundation, liquid crystal is able to achieve the modulation of light by electrical signals, upon which LCD is built. Under various electrical fields from liquid crystal capacitors, liquid crystal molecules may be tilted up to 90 degrees, causing difference in transmittance and therefore in brightness. Each pixel is controlled based this principle, and a desired image is as such produced. The present embodiment is mainly about the control of the tilt angle of individual liquid crystal molecule so that an image may be formed.

In the following embodiments, the display panel includes a number sub-pixel units, gate lines, and source lines. The sub-pixel units, under the control of signals from the source lines, produce voltages to alter the tilt angles of liquid crystal molecules. Gate lines, or scan lines, are to make the sub-pixel units to receive signals from the source lines. Source lines, or data lines, control the sub-pixel units to produce voltages. Usually a gate line controls a row of sub-pixel units so that these sub-pixels units receive signals from respective source lines. Then, another gate line turns on another row of sub-pixel units so that they receive signals from respective source lines. This process is repeated so that all sub-pixel units are sequentially controlled.

Figure 1:
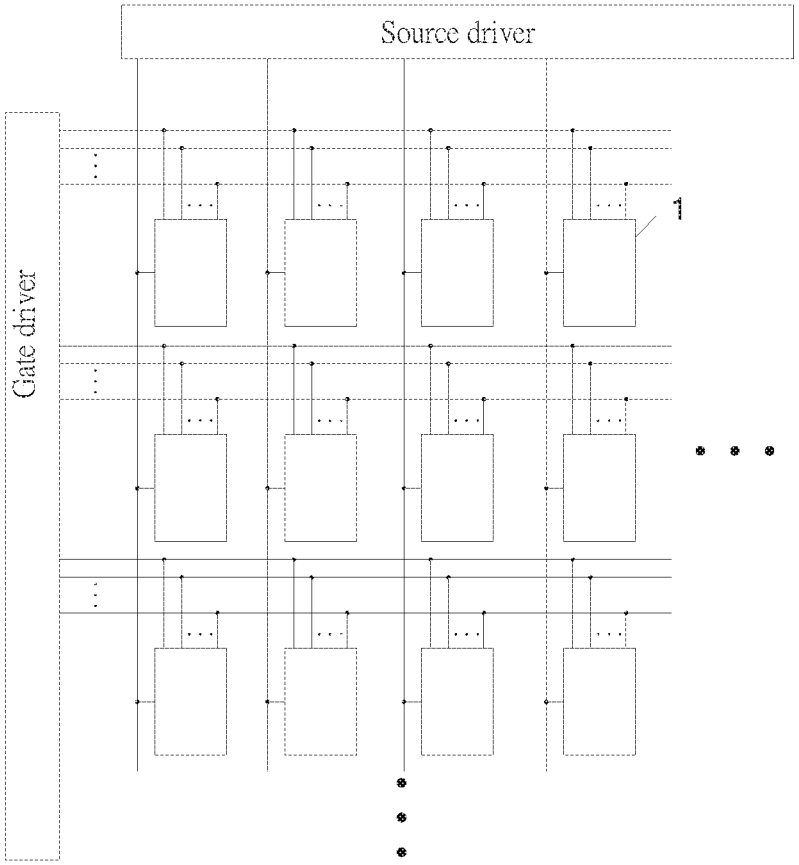
FIG. 1 is a schematic diagram showing a display panel according to an embodiment of the present invention.

As shown in FIG. 1, a display panel according to an embodiment the present invention includes a gate driver, a source driver, multiple gate lines, multiple source lines, and multiple basic pixel units 1.

As illustrated,the basic pixel units 1 are arranged in an array. All gate lines are connected to the gate driver, and all source lines are connected to the source driver. Each basic pixel unit 1 is connected to a number of gate lines, and the basic pixel units along a same column are connected to a source line.

Figure 2:
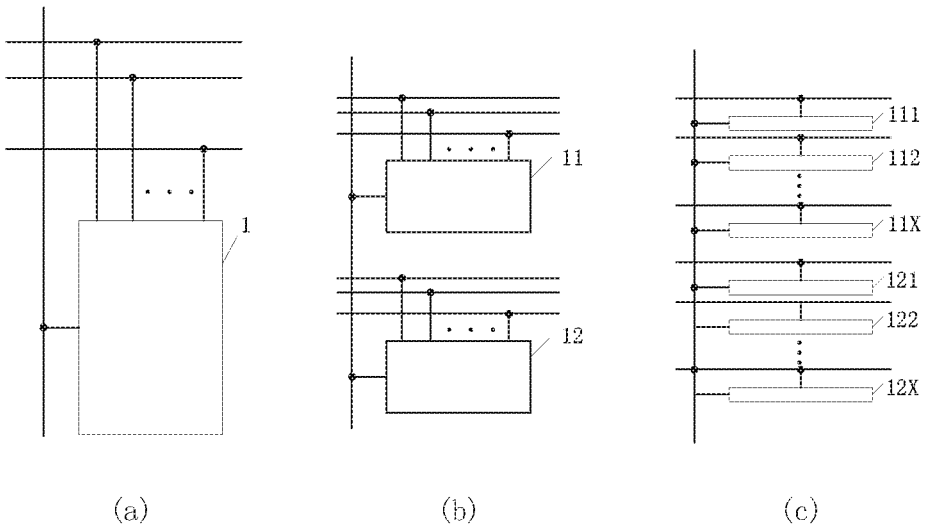
FIG. 2 is a schematic diagram showing a basic pixel unit of the display panel of FIG. 1 at different levels of details.

As shown in FIG. 2, each basic pixel unit 1 is structured identically and includes a first pixel unit 11 and a second pixel unit 12. The first and second pixel units 11 and 12 are aligned vertically. The first pixel unit 11 may be above or below the second pixel unit 12. Each of the first and second pixel units 11 and 12 includes multiple sub-pixel units. Those sub-pixel units of a first pixel unit 11 are referred to as the first sub-pixel units, and those of a second pixel unit 12 are referred to as the second sub-pixel units. As shown in FIG. 2, (a) is a schematic diagram for a basic pixel unit 1, (b) is a schematic diagram for a first pixel unit 11 and a second pixel unit 12, and (c) is a schematic diagram for first and second sub-pixel units. It should be noted that what is revealed in (a), (b), and (c) is a same structure at different levels of details.

Furthermore, when the first and second pixel units 11 and 12 are under a same effective input signal, the selected sub-pixel unit of the first pixel unit 11 has a greater voltage on its liquid crystal capacitor than that of the selected sub-pixel unit of the second pixel unit 12. Specifically, a sub-pixel unit within the first pixel unit 11 is selected under the control of gate lines, receives a non-zero effective input signal from a source line, and thereby produces a first voltage on the liquid crystal capacitor of the sub-pixel unit. At a different moment, a sub-pixel unit within the second pixel unit 12 is selected under the control agate lines, receives the same non-zero effective input signal from the source line, and produces a second voltage on the liquid crystal capacitor of the sub-pixel unit. The first voltage is greater than the second voltage.

Compared to the single gate drive or the tri-gate drive, the voltages of the liquid crystal capacitors are influenced only the input signals from the source lines. Under a same effective input signal, the voltage of every sub-pixel unit's liquid crystal capacitor is identical. In contrast, the present embodiment provides different voltages on these sub-pixel units' liquid crystal capacitors, thereby improving LCD's viewing angle, color deviation, and display quality.

Figure 3:
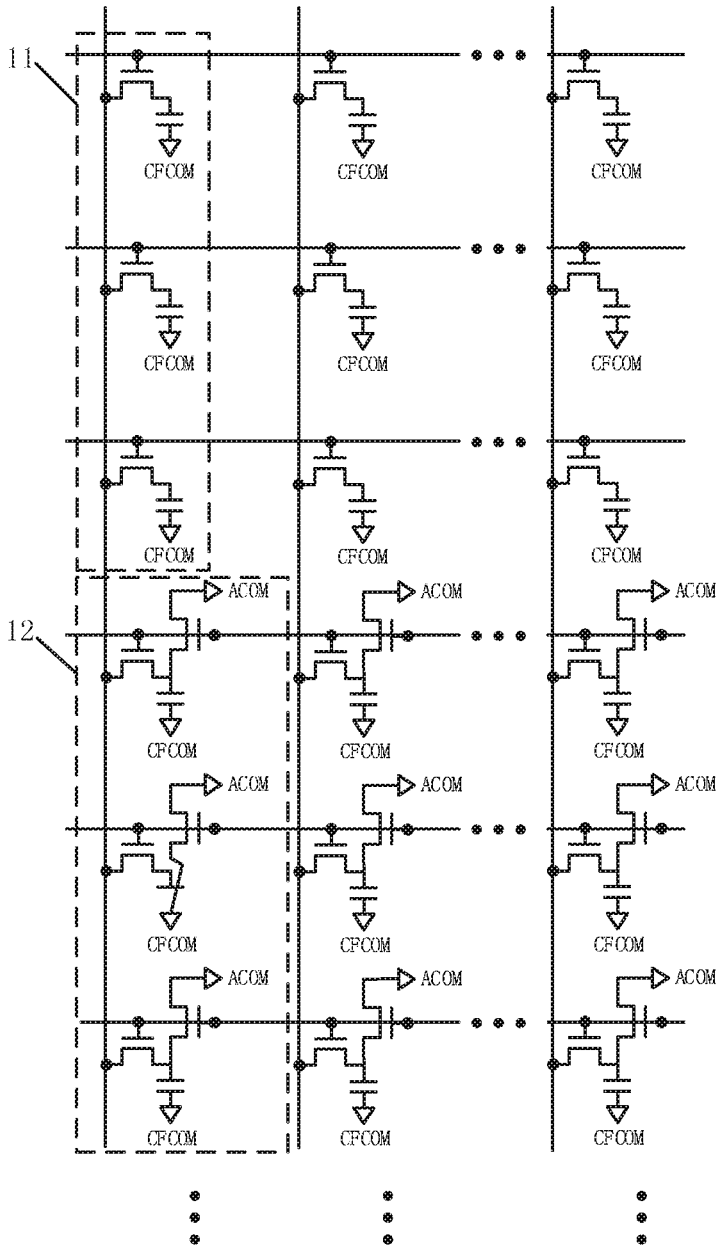
FIG. 3 is a circuit diagram showing the display panel of FIG. 1.

According to an embodiment shown in FIG. 3, each sub-pixel unit of the first pixel unit 11 includes a first tin-film transistors (TFT) and a first liquid crystal capacitor. The first TFT has its gate electrically connected to a gate line connected to the sub-pixel unit, its source electrically connected to a source line connected to the sub-pixel unit, and its drain electrically connected to a first terminal of the first liquid crystal capacitor. A second terminal of the first liquid crystal capacitor is electrically connected to a first reference voltage. Each sub-pixel unit of the second pixel unit includes a second TFT, a third TFT, and a second liquid crystal capacitor. The second TFT has its gate electrically connected to a gate line connected to the sub-pixel unit, its source electrically connected to a source line connected to the sub-pixel unit, and its drain electrically connected to a first terminal of the second liquid crystal capacitor and the third TFT's source. The third TFT has its gate electrically connected to the gate line connected to the sub-pixel unit, and its drain electrically connected to a second reference voltage. A second terminal of the second liquid crystal capacitor is electrically connected to the first reference voltage.

As shown in FIG. 3, the first and second TFTs, under the signal control by the gate lines, receives signals from the source line. The first and second liquid crystal capacitors produce electrical field to tilt the liquid crystal molecules. The third TFTs provide voltage division to the voltages of the second liquid crystal capacitors. The first reference voltage may be drawn from the color filter's common line CFCOM, and the second reference voltage may be drawn from the array substrate's common line ACOM.

Figure 4:
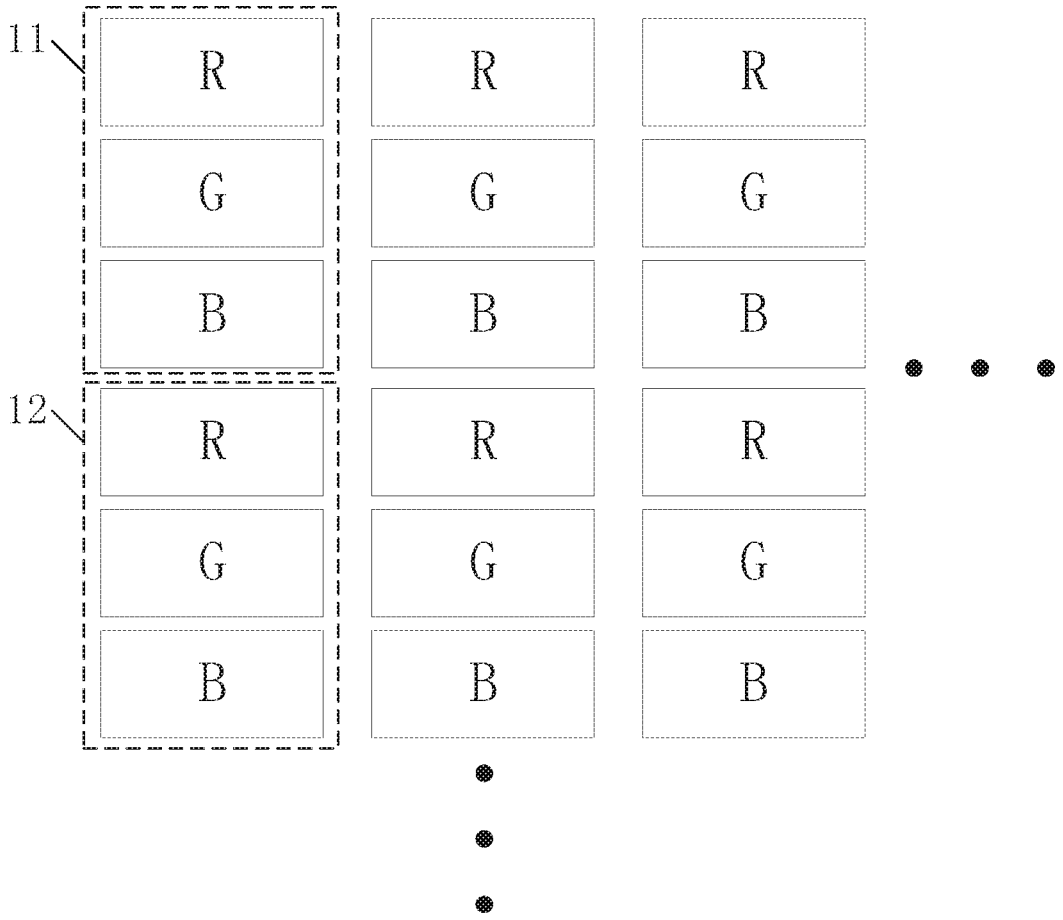
FIG. 4 is a schematic diagram showing the arrangement of sub-pixel units according to an embodiment of the present invention.

In the present embodiment, the first and second sub-pixel units may be used to present colored or black/white light. As shown in FIG. 4, for presenting colored light, the first sub-pixel units include a red (R) sub-pixel unit, a green (G) sub-pixel unit, and a blue (B) sub-pixel unit. Similarly the second sub-pixel units include a red (R) sub-pixel unit, a green (G) sub-pixel unit, and a blue (B) sub-pixel unit. The present invention is not limited to the arrangement shown in FIG. 4. It may be implemented that the first or second sub-pixel units are ordered as B, G, R, or as R, B, G.

Figure 5:
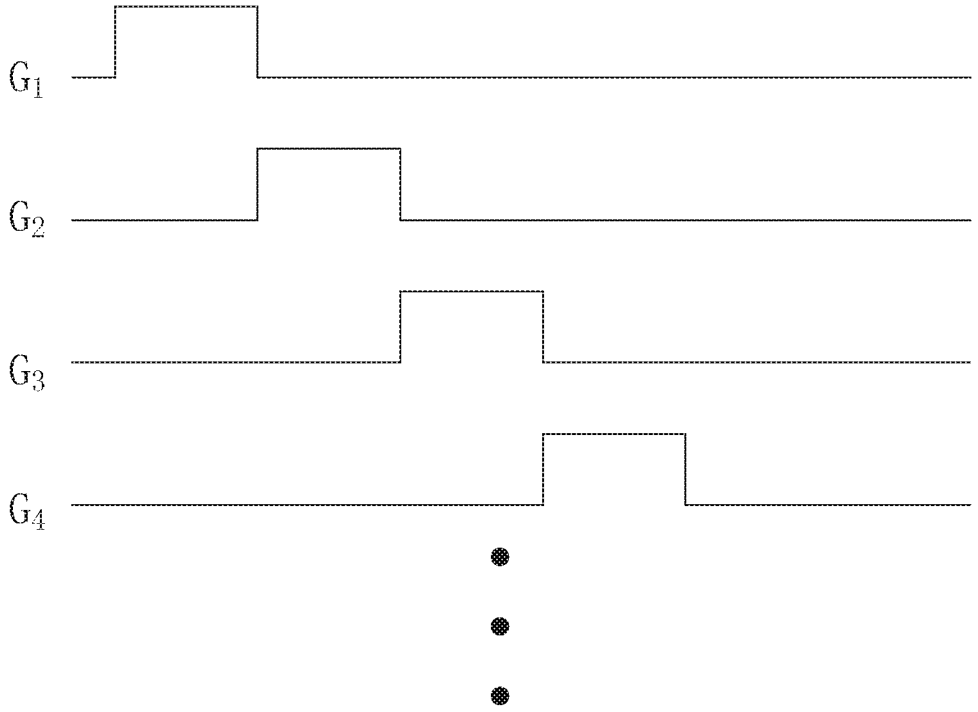
FIG. 5 is a timing diagram for signals output on the gate lines of the display panel of FIG. 1.

FIG. 5 provides a timing diagram for signals output on the gate lines from top to bottom. As illustrated, the falling edge of the pulse signal on the gate line for the n-th row of sub-pixel units coincides with the rising edge of the pulse signal on the gate line for the (n+1)-th row of sub-pixel units. The pulse signals on the gate lines have an identical period. n is a positive integer.

The present invention also provides a LCD. According to FIGS. 1 to 4, the LCD includes a display panel and a display body. The display panel includes a gate driver, a source driver, multiple gate lines, multiple source lines, and multiple basic pixel units 1.

As illustrated in FIG. 1, the basic pixel units 1 are arranged in an array. All gate lines are connected to the gate driver, and all source lines are connected to the source driver. Each basic pixel unit 1 is connected to a number of gate lines, and the basic pixel units along a same column are connected to a source line.

As shown in FIG. 2, each basic pixel unit 1 is structured identically and includes a first pixel unit 11 and a second pixel unit 12. The first and second pixel units 11 and 12 are aligned vertically. The first pixel unit 11 may be above or below the second pixel unit 12. Each of the first and second pixel units 11 and 12 includes multiple sub-pixel units. Those sub-pixel units of a first pixel unit 11 are referred to as the first sub-pixel units, and those of a second pixel unit 12 are referred to as the second sub-pixel units. As shown in FIG. 2, (a) is a schematic diagram for a basic pixel unit 1, (b) is a schematic diagram for a first pixel unit 11 and a second pixel unit 12, and (c) is a schematic diagram for first and second sub-pixel units. It should be noted that what is revealed in (a), (b), and (c) is a same structure at different levels of details.

Furthermore, when the first and second pixel units 11 and 12 are under a same effective input signal, the selected sub-pixel unit of the first pixel unit 11 has a greater voltage on its liquid crystal capacitor than that of the selected sub-pixel unit of the second pixel unit 12. Specifically, a sub-pixel unit within the first pixel unit 11 is selected under the control of gate lines, receives a non-zero effective input signal from a source line, and thereby produces a first voltage on the liquid crystal capacitor of the sub-pixel unit. At a different moment, a sub-pixel unit within the second pixel unit 12 is selected under the control of gate lines, receives the same non-zero effective input signal from the source line, and produces a second voltage on the liquid crystal capacitor of the sub-pixel unit. The first voltage is greater than the second voltage.

Compared to the single gate drive or the tri-gate drive, the voltages of the liquid crystal capacitors are influenced only the input signals from the source lines. Under a same effective input signal, the voltage of every sub-pixel unit's liquid crystal capacitor is identical. In contrast the present embodiment provides different voltages on these sub-pixel units' liquid crystal capacitors, thereby improving LCD's viewing angle, color deviation, and display quality.

According to an embodiment shown in FIG. 3, the first pixel unit 11 includes first thin-film transistors (TFTs) and first liquid crystal capacitors. Each first TFT has its gate electrically connected to a gate line connected to a sub-pixel unit of the first pixel unit 11, its source electrically connected to a sub-pixel unit of the first pixel unit 11, and its drain electrically connected to a first terminal of a first liquid crystal capacitor. A second terminal of the first liquid crystal capacitor is electrically connected to a first reference voltage. The second pixel unit 12 includes second TFTs, third TFTs, and second liquid crystal capacitors. Each second TFT has its gate electrically connected to a gate line connected to a sub-pixel unit of the second pixel unit 12, its source electrically connected to a sub-pixel unit of the second pixel unit 12, and its drains electrically connected to a first terminal of a second liquid crystal capacitor and a third TFT's source. The third TFT has its gate electrically connected to the gate line connected to the sub-pixel unit of the second pixel unit 12, and its drain electrically connected to a second reference voltage. A second terminal of the second liquid crystal capacitor is electrically connected to the first reference voltage.

As shown in FIG. 3, the first and second TFTs, under the signal control by the gate lines, receives signals from the source line. The first and second liquid crystal capacitors produce electrical field to tilt the liquid crystal molecules. The third TFTs provide voltage division to the voltages of the second liquid crystal capacitors. The first reference voltage may be drawn from the color filter's common line CFCOM, and the second reference voltage may be drawn from the array substrate's common line ACOM.

In the present embodiment, the first and second sub-pixel units may be used to present colored or black/white light. As shown in FIG. 4, for presenting colored light, the first sub-pixel units include a red (R) sub-pixel unit a green (G) sub-pixel unit, and a blue (B) sub-pixel unit. Similarly, the second sub-pixel units include a red (R) sub-pixel unit, a green (G) sub-pixel unit and a blue (B) sub-pixel unit. The present invention is not limited to the arrangement shown in FIG. 4. It may be implemented that the first or second sub-pixel units are ordered as B, G, R, or as R, B, G.

The timing diagram for signals output on the gate lines from top to bottom is shown in FIG. 5. As illustrated, the falling edge of the pulse signal on the gate line for the n-th row of sub-pixel units coincides with the rising edge of the pulse signal on the gate line for the (n+1)-th row of sub-pixel units. The pulse signals on the gate lines have an identical period. n is a positive integer.

A person skilled in the related art should understand that all or part of the above disclosure can be achieved by software programs controlling related hardware. The software programs may be stored in a computer-accessible medium such as a magnetic disk, an optical disk, a Read-Only Memory (ROM), or a Random Access Memory (RAM).

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A display panel, comprising a plurality of basic pixel units arranged in an array, wherein each basic pixel unit comprises a first pixel unit and a second pixel unit;

the first and second pixel units are aligned vertically; and under a same effective input signal, a selected sub-pixel unit of the first pixel unit has a first voltage on its liquid crystal capacitor, a selected sub-pixel unit of the second pixel unit has a second voltage on its liquid crystal capacitor, and the first voltage is greater than the second voltage;

wherein the first pixel unit comprises a first red sub-pixel unit, a first green sub-pixel unit, and a first blue sub-pixel unit, arranged vertically in this order; and the second pixel unit comprises a second red sub-pixel unit, a second green sub-pixel unit, and a second blue sub-pixel unit, arranged vertically in this order;

wherein each sub-pixel unit of the first pixel unit comprises a first thin-film transistors (TFT) and a first liquid crystal capacitor; the first TFT has its gate electrically connected to a gate line connected to the sub-pixel unit, its source electrically connected to a source line connected to the sub-pixel unit, and its drain electrically connected to a first terminal of the first liquid crystal capacitor; a second terminal of the first liquid crystal capacitor is electrically connected to a first reference voltage;

each sub-pixel unit of the second pixel unit includes a second TFT, a third TFT, and a second liquid crystal capacitor; the second TFT has its gate electrically connected to a gate line connected to the sub-pixel unit, its source electrically connected to a source line connected to the sub-pixel unit, and its drain electrically connected to a first terminal of the second liquid crystal capacitor and the third TFT's source; the third TFT has its gate electrically connected to the gate line connected to the sub-pixel unit, and its drain electrically connected to a second reference voltage; and a second terminal of the second liquid crystal capacitor is electrically connected to the first reference voltage; and wherein the first reference voltage is drawn from a color filter's common line; and the second reference voltage is drawn from an array substrate's common line.

2. The display panel according to claim 1, wherein, for the first and second pixel units of a same basic pixel unit, the first pixel unit is above the second pixel unit.

3. The display panel according to claim 1, wherein a falling edge of a first pulse signal on a first gate line for a n-th row of sub-pixel units coincides with a rising edge of a second pulse signal on a second gate line for the (n+1)-th row of sub-pixel units; the first and second pulse signals on the first and second gate lines have an identical period; and n is a positive integer.

4. The display panel according to claim 1, wherein a falling edge of a first pulse signal on a first gate line for a n-th row of sub-pixel units coincides with a rising edge of a second pulse signal on a second gate line for the (n+1)-th row of sub-pixel units; the first and second pulse signals on the first and second gate lines have an identical period; and n is a positive integer.

5. A liquid crystal display, comprising a display panel and a display body, wherein the display panel comprises a plurality of basic pixel units arranged in an array, each basic pixel unit comprises a first pixel unit and a second pixel unit;

the first and second pixel units are aligned vertically; and under a same effective input signal, a selected sub-pixel unit of the first pixel unit has a first voltage on its liquid crystal capacitor, a selected sub-pixel unit of the second pixel unit has a second voltage on its liquid crystal capacitor, and the first voltage is greater than the second voltage;

wherein the first pixel unit comprises a first red sub-pixel unit, a first green sub-pixel unit, and a first blue sub-pixel unit, arranged vertically in this order; and the second pixel unit comprises a second red sub-pixel unit, a second green sub-pixel unit, and a second blue sub-pixel unit, arranged vertically in this order;

wherein each sub-pixel unit of the first pixel unit comprises a first thin-film transistors (TFT) and a first liquid crystal capacitor; the first TFT has its gate electrically connected to a gate line connected to the sub-pixel unit, its source electrically connected to a source line connected to the sub-pixel unit, and its drain electrically connected to a first terminal of the first liquid crystal capacitor; a second terminal of the first liquid crystal capacitor is electrically connected to a first reference voltage; each sub-pixel unit of the second pixel unit includes a second TFT, a third TFT, and a second liquid crystal capacitor; the second TFT has its gate electrically connected to a gate line connected to the sub-pixel unit, its source electrically connected to a source line connected to the sub-pixel unit, and its drain electrically connected to a first terminal of the second liquid crystal capacitor and the third TFT's source; the third TFT has its gate electrically connected to the gate line connected to the sub-pixel unit, and its drain electrically connected to a second reference voltage; and a second terminal of the second liquid crystal capacitor is electrically connected to the first reference voltage; and wherein the first reference voltage is drawn from a color filter's common line; and the second reference voltage is drawn from an array substrate's common line.

6. The liquid crystal display according to claim 5, wherein, for the first and second pixel units of a same basic pixel unit, the first pixel unit is above the second pixel unit.

7. The liquid crystal display according to claim 5, wherein a falling edge of a first pulse signal on a first gate line for a n-th row of sub-pixel units coincides with a rising edge of a second pulse signal on a second gate line for the (n+1)-th row of sub-pixel units; the first and second pulse signals on the first and second gate lines have an identical period; and n is a positive integer.

8. The liquid crystal display according to claim 5, wherein a falling edge of a first pulse signal on a first gate line for a n-th row of sub-pixel units coincides with a rising edge of a second pulse signal on a second gate line for the (n+1)-th row of sub-pixel units; the first and second pulse signals on the first and second gate lines have an identical period; and n is a positive integer.

* * * * *